US006149448A

United States Patent [19]

Haller et al.

[11] Patent Number: 6,149,448

[45] Date of Patent: Nov. 21, 2000

[54] ELECTRICAL CONNECTOR ASSEMBLY

[75] Inventors: Wolfgang Haller, Schwaikheim; Hans Kieninger, Stuttgart, both of Germany

[73] Assignee: ITT Manufacturing Enterprises, Inc., Wilmington, Del.

[21] Appl. No.: 09/248,966

[22] Filed: Feb. 12, 1999

Related U.S. Application Data

[63] Continuation-in-part of application No. PCT/EP97/04373, Aug. 12, 1997.

[30] Foreign Application Priority Data

Aug. 16, 1997 [DE] Germany ..... 196 32 905

[51] Int. Cl.[7] ..... H01R 29/00

[52] U.S. Cl. ..... 439/188

[58] Field of Search ..... 439/152, 188, 439/675, 788, 824, 840, 841, 923

[56] References Cited

U.S. PATENT DOCUMENTS

| | | | |
|---|---|---|---|
| 4,846,714 | 7/1989 | Welsby et al. | 439/348 |
| 5,074,809 | 12/1991 | Rousseau | 439/675 |
| 5,334,025 | 8/1994 | Fohl | 439/188 |
| 5,350,317 | 9/1994 | Weaver et al. | 439/500 |
| 5,562,506 | 10/1996 | Wright | 439/675 |
| 5,921,793 | 7/1999 | Phillips | 439/188 |

*Primary Examiner*—Khiem Nguyen
*Assistant Examiner*—Brian S. Webb
*Attorney, Agent, or Firm*—Thomas L. Peterson

[57] ABSTRACT

An electrical connector assembly (10) includes first and second connectors (11, 12) that each has inner and outer contacts, which provides a visual and tactile indication when the two connectors have not been fully mated. The first outer contact is in the form of a helical spring (16) of electrically conductive material which is contacted by the outer second contact (41) and compressed as mating continues until a detent (74) on one connector engages a groove shoulder (116) on the other connector. If connector mating stops before the detent engages the groove shoulder, the spring will push apart the two connectors to clearly indicate that full mating has not been achieved. A front end of the spring is bent to form a prong (31) that engages the first inner contact front end (102) prior to mating but which is deflected out of contact during mating, with the opposite end of the spring forming a rear terminal (29) of the first connector.

14 Claims, 9 Drawing Sheets

ELECTRICAL CONNECTOR ASSEMBLY

CROSS REFERENCE TO RELATED APPLICATION

This application is a Continuation-In-Part of PCT/EP97/04373 filed Aug. 12, 1997, which claims priority from German patent application 196 32 905.1 filed Aug. 16, 1996.

BACKGROUND OF THE INVENTION

Coaxial connectors commonly include a detent on one of them which engages a shoulder on the other to latch the connectors when they have been fully mated so they greatly resist unmating. However, when the connectors are slightly less than fully mated, they will commonly appear to be fully mated, but with their contacts remaining engaged only until vibrations or unmating forces progressively unmate the connectors until their contacts are no longer connected. In certain applications such as connectors that connect a vehicle battery to a squib that sets off a pyrotechnic device that inflates an airbag in the event of a crash, such unmating of the connectors might go undetected until the airbag must be inflated. A connector assembly that clearly indicated when the two connectors were not fully mated and fully latched together, would be of value.

The connector that carries current to the squib, is commonly provided with a shorting device that shorts the inner and outer contacts prior to mating of the connector with another one. Otherwise, static electricity buildup or stray radio currents, could set off the squib and the airbag. It is common for connectors to provide a separate device to connect the inner and outer contacts prior to connector mating. If the shorting device could be incorporated into one of the contacts, this would simplify and reduce the cost of the connector.

SUMMARY OF THE INVENTION

In accordance with one embodiment of the present invention, a connector assembly is provided which includes inner and outer contacts that mate when the connectors are moved together. A detent on one connector engages a shoulder on the other connector to latch the connectors when they are fully mated. The outer contact of the first connector is in the form of a helical spring which is compressed by the outer contact of the second connector as the connectors mate. If a technician stops pushing the two connectors together prior to engagement of the detent with the shoulder, the spring will push the connectors apart to clearly indicate that the connectors have not been fully mated.

The inner contact of the first connector is in the form of a pin, with an exposed upper end and with a dielectric inner body surrounding the rest of the pin. A shorting device for shorting the outer and inner contacts of the first connector, is provided by bending the front end of the spring to form a prong that extends radially inwardly and engages the exposed pin front end. When the connectors mate and the spring is compressed, its prong moves rearwardly and in so doing moves over a tapered front end of the dielectric inner body to break contact with the pin.

The novel features of the invention are set forth with particularity in the appended claims. The invention will be best understood from the following description when read in conjunction with the accompanying drawings.

DESCRIPTION OF THE PREFERRED EMBODIMENT

Figure 1:
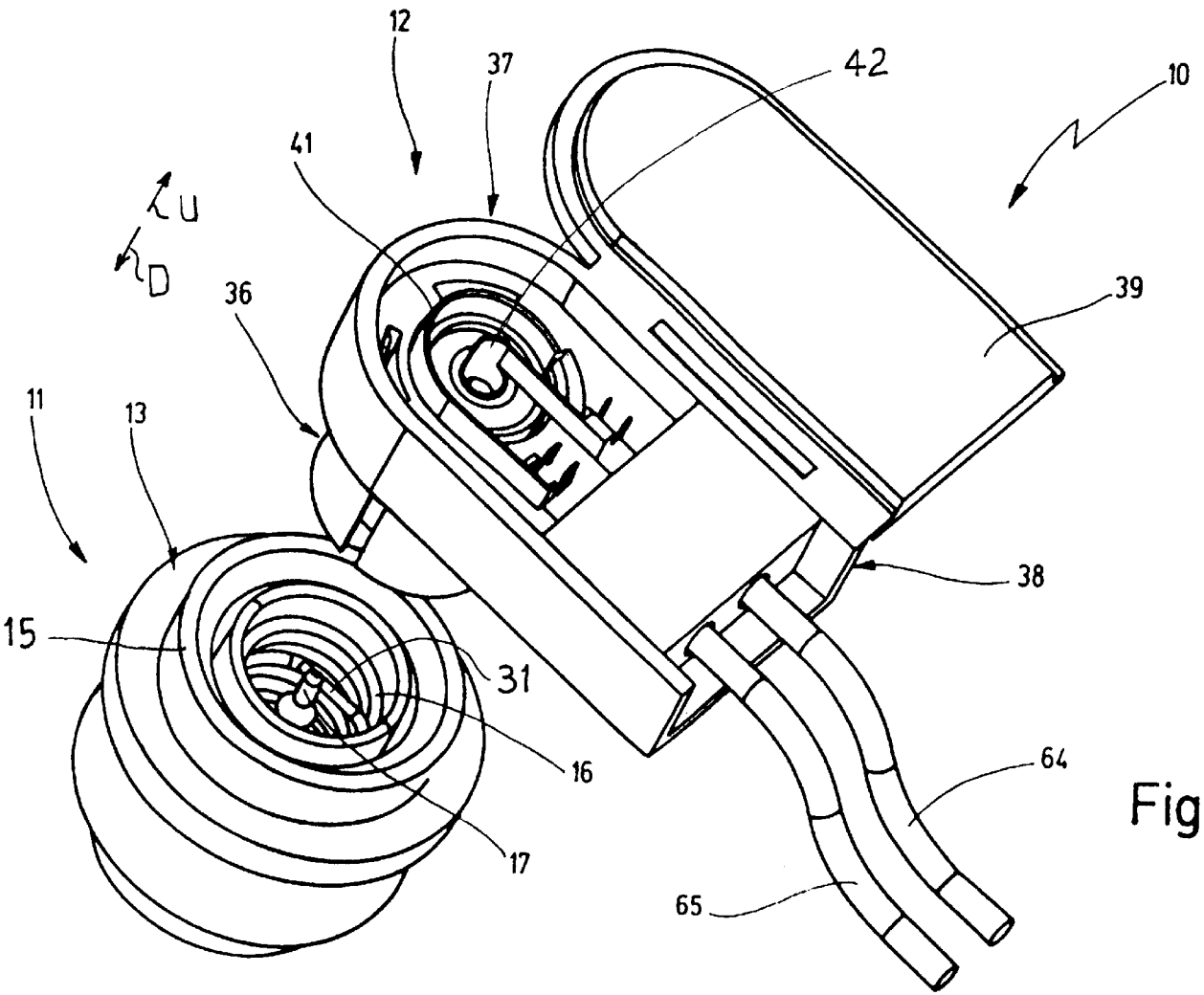
FIG. 1 is an isometric view of a connector assembly with the first and second connectors being separated but aligned for mating.
Figure 2:
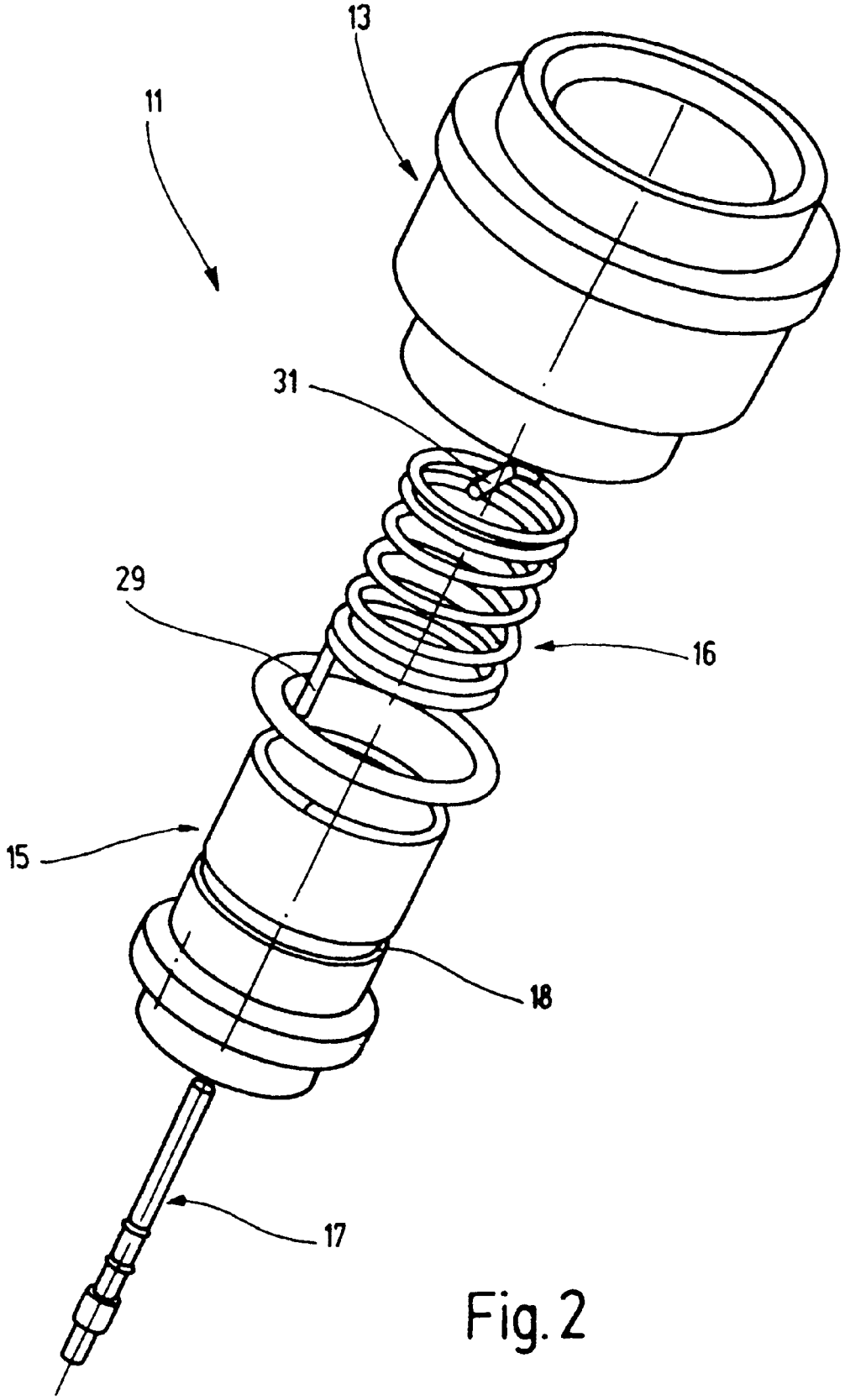
FIG. 2 is an exploded isometric view of the first connector of the assembly of FIG. 1.

FIG. 1 illustrates a connector assembly 10 which is designed for use in a vehicle, to connect a battery to a squib that initiates a pyrotechnic device to inflate airbags in the event of a crash. The assembly includes first and second connectors 11, 12, with the second connector having inner and outer contacts 42, 41 that are connected respectively to wires 64, 65 that connect to a vehicle battery. The first connector has inner and outer contacts 17, 16 that mate with the inner and outer contacts of the second connector. The contacts 17, 16 of the first connector connect to an initiator for initiating inflation of a vehicle airbag.

Figure 9:
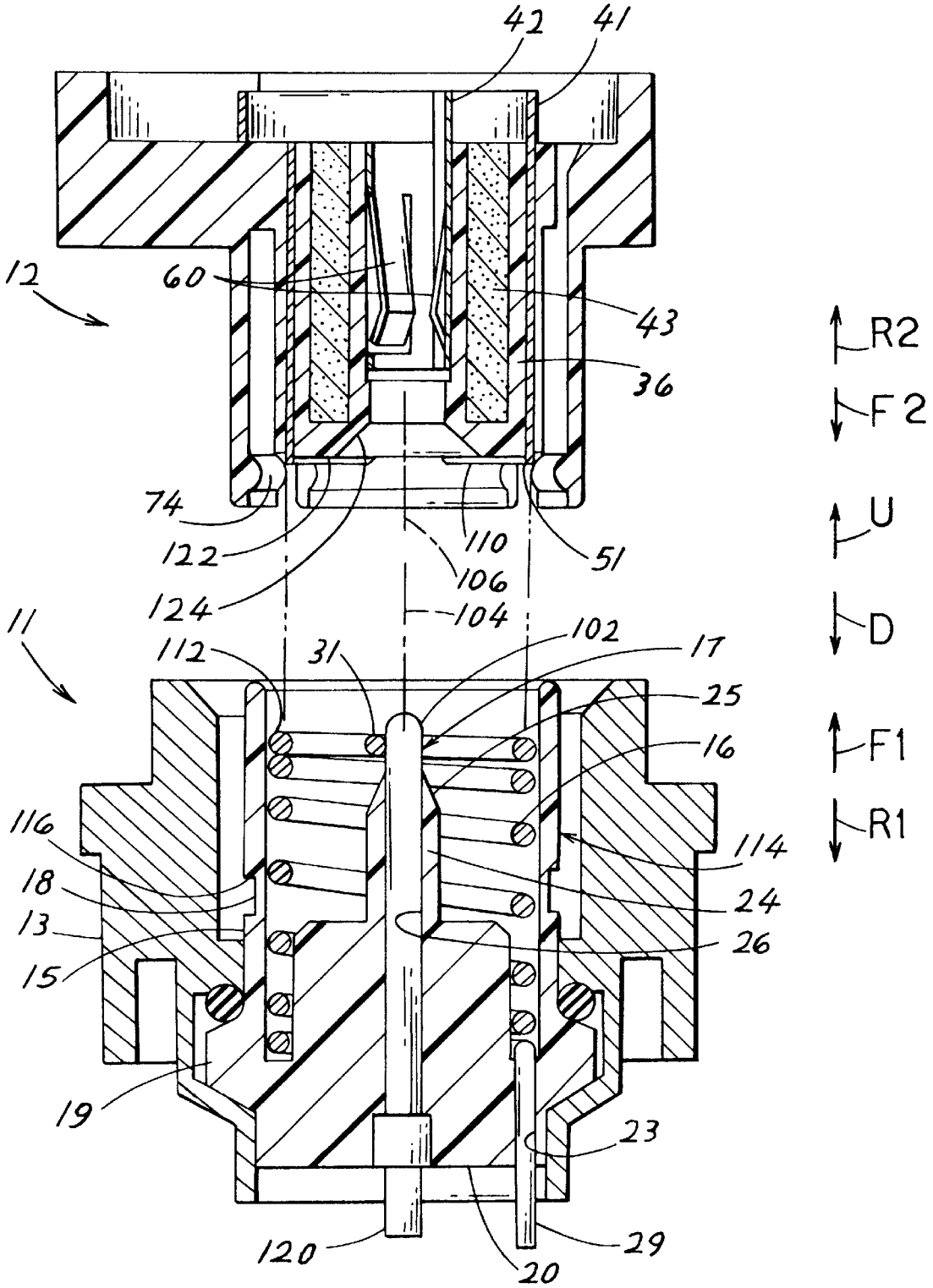
FIG. 9 is a sectional view of the connector assembly of FIG. 1 with the connectors separated.

FIG. 9 shows details of the first and second connectors 11, 12. Arrows F1 and R1 are forward (mating) and rearward (unmating) directions for the first connector 11, while arrows F2 and R2 are forward and rearward directions for the second connector 12. Arrows U, D are up and down directions for both connectors. The inner contact 17 of the first connector is in the form of a pin with an exposed front or upper end 102 lying along a first axis 104. The second contact 16 of the first connector is in the form of a helical spring which is centered on the axis 104. The first and second contacts 42, 41 of the second connector are in the form of sleeves which are centered on a second axis 106. The two axes 104, 106 are aligned prior to the connectors being moved together to mate them.

When the connectors mate, tines 60 of the inner contact 42 engage the exposed upper end 102 of the inner contact 17. The front end 110 of the second outer contact 41 presses down against the topmost turn 112 of the spring. As mating of the connectors progresses, a detent 74 formed in the housing 36 of the second connector moves down around a dielectric tube 15 of the first connector dielectric housing 114, until the detent 74 snaps into a detent groove 18. The detent is prevented from being pulled up by a shoulder 116 formed at the top of the groove. The connector could be made so it requires a large upward force such as 50 pounds to unmate the connectors. Applicant prefers to construct the detent and groove so one of them will break before they unmate, but so a special tool can be inserted to release the detent from the groove so the connectors can be unmated.

If a technician partially mates the connectors, so the detent 74 has not quite reached the groove 18, such partial mating would be dangerous because vehicle vibrations and the like could cause sufficient unmating that one of the pairs of contacts were not in low resistance engagement with each other. This could result in an airbag not inflating in the event of a crash. The fact that less than full mating has occurred, prior to the detent 74 being latched in the groove 18, is indicated by the helical spring pushing the contacts apart. Such pushing apart is a strong indication to the technician that the connectors have not been fully mated, and thereby avoids less than full mating.

Figure 3:
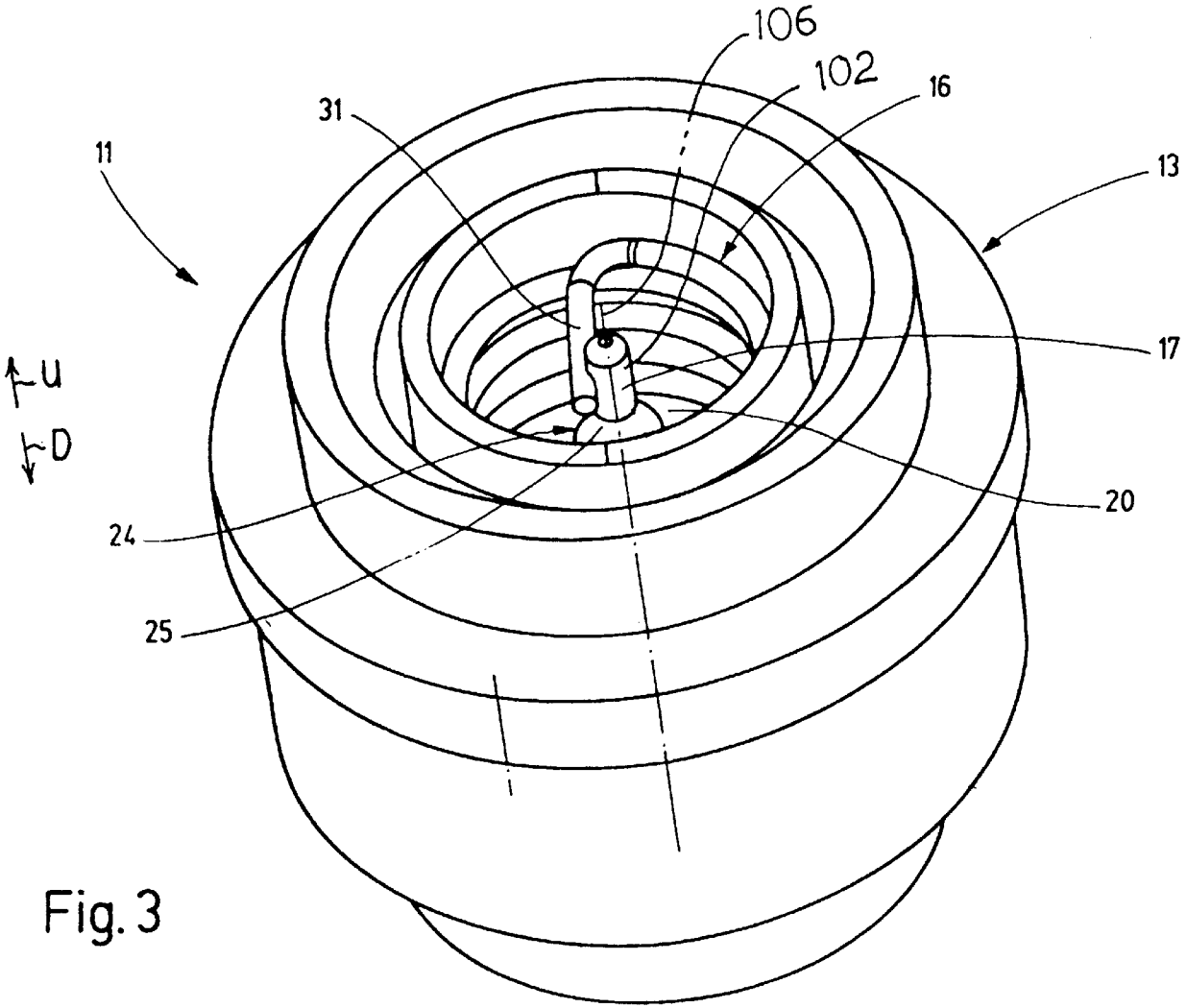
FIG. 3 is a top isometric view of the connector of FIG. 2 after it has been assembled.
Figure 4:
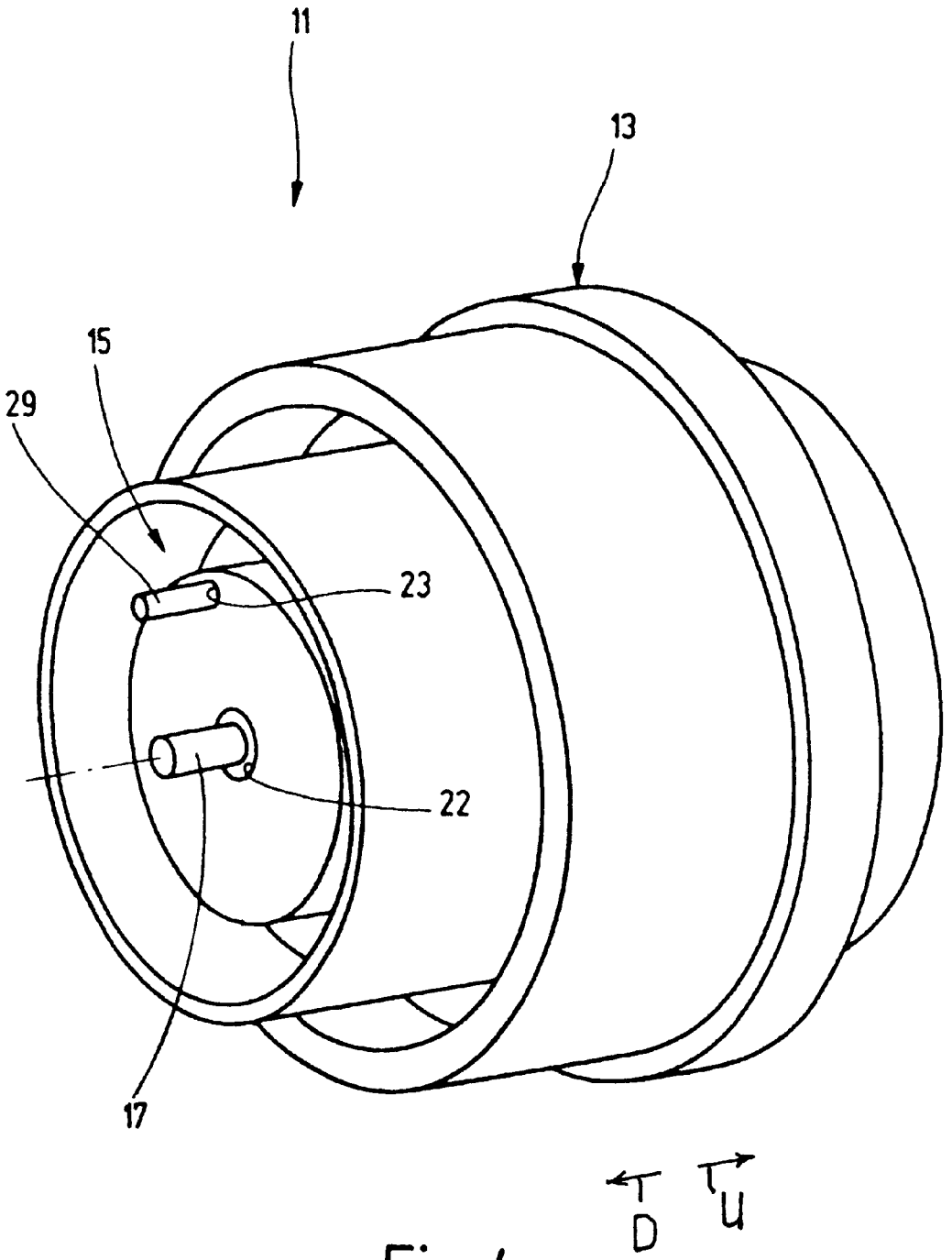
FIG. 4 is a bottom isometric view of the connector of FIG. 3.
Figure 5:
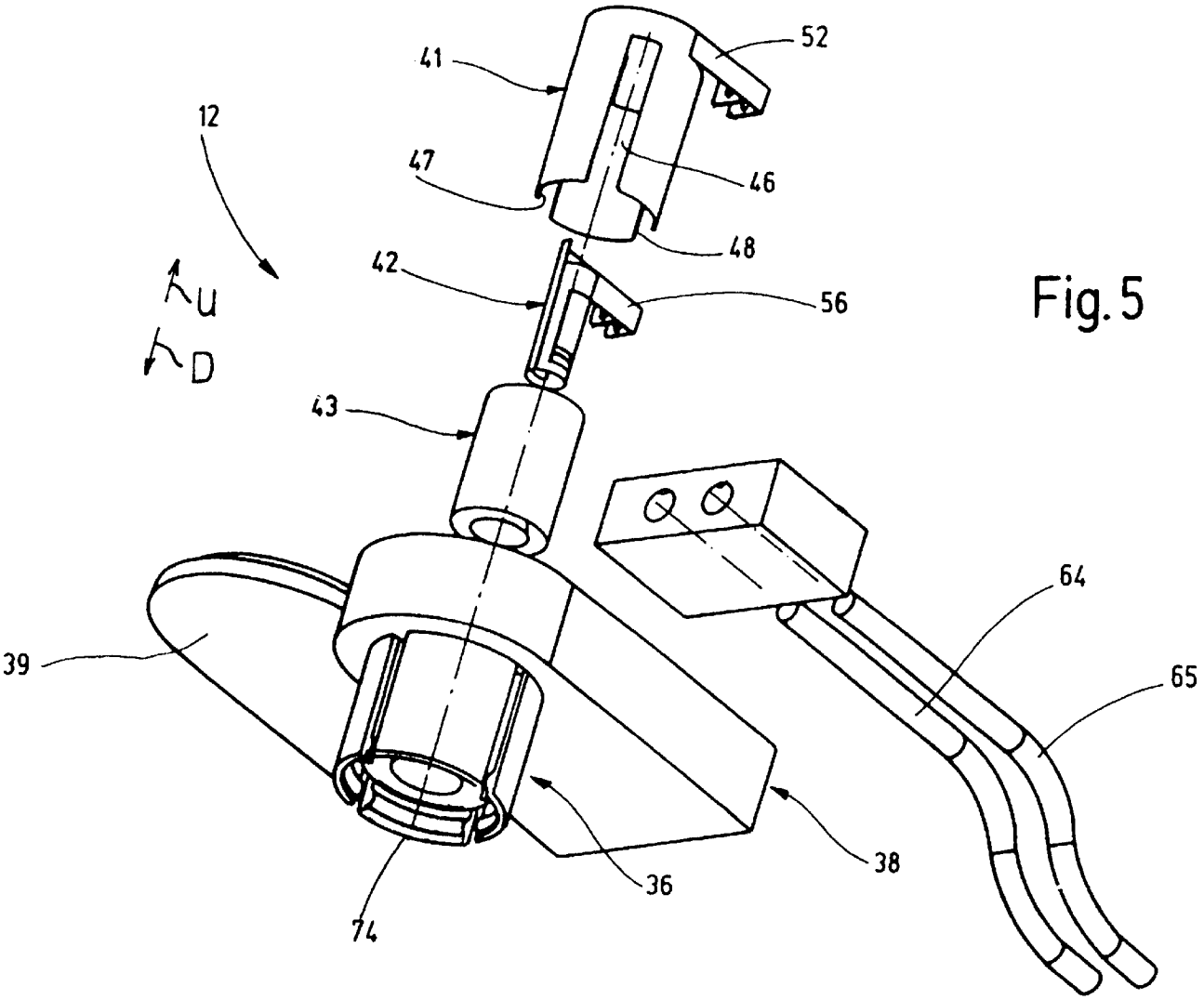
FIG. 5 is an exploded bottom isometric view of the second connector of the assembly of FIG. 1.

As shown in FIG. 3, the top of the spring includes a spring end 31 that is bent to extend largely radial to the axis 106 and form a prong engaged with the pin exposed upper end 102. Referring again to FIG. 9, it can be seen that when the helical spring 16 is compressed and causes the short circuiting prong 31 to move down, the prong moves along the conical or tapered upper end 25 of a dielectric inner body 24 of the first connector housing. In moving along the tapered upper end 25 of the body, the prong 31 is moved out of engagement with the inner contact. This will allow current to flow separately through the two pairs of mated contacts. As discussed earlier, the shorting prong 31 is used to prevent the buildup of static electricity or picked-up radio waves, to cause accidental initiating of the pyrotechnics connected to the first connector, prior to mating of the connectors.

The provision of the shorting prong 31 on the end of the spring is advantageous because it avoids the need for a separate shorting device and the need to mount it, and because it results in a highly reliable shorting device. The high reliability with which the shorting device operates, is due to the fact that it has the resilience of the helical spring to enable it to be deflected radially outwardly from the exposed upper end 102 of the inner contact, while it moves downward along the tapered upper end 25 of the dielectric inner body 24 and then along the inner body. Previous devices had to be small in length, resulting in limited resilience unless a coil spring were used, which added to the complexity of the device and its installation. The prong 31 is in initially bent perhaps 85° from a circumferential direction (from an extension of the top turn 112), and the pin end 102 bends it to perhaps 110° from the circumferential direction.

The lower ends of the inner and outer first contacts 17, 16 project through a rear wall 20 of the first housing 114 and project rearwardly therefrom to form terminals 120, 29 for connection to a squib or other device. Applicant forms the outer terminal by initially bending the helical spring so its lower end forms an axially extending part that forms the terminal 29, and by projecting the terminal through a hole in the housing rear wall. This simplifies the first connector to make it more reliable and of lower cost.

The dielectric tube 15 of the first housing has an inside that closely surrounds the helical spring 16, or at least closely surrounds the topmost turn 112 of the helical spring when the spring is compressed. Only an airgap lies between the spring and the dielectric inner body 24. The second connector body has a deflecting part 122 that moves into this space and helps to push down the shorting prong 31 and compress the spring. If the lower end 51 of the outer sleeve 41 slips off of the top of the spring, the outer sleeve 41 will still engage the spring. The deflecting part 122 also forms a tapered lead-in 124 that guides the pin upper end 102 into the inner sleeve 42. The first connector includes a metal shell 13 that surrounds the dielectric housing 114 and which protects the mated connectors while also providing EMI (electromagnetic interference) protection.

Figure 6:
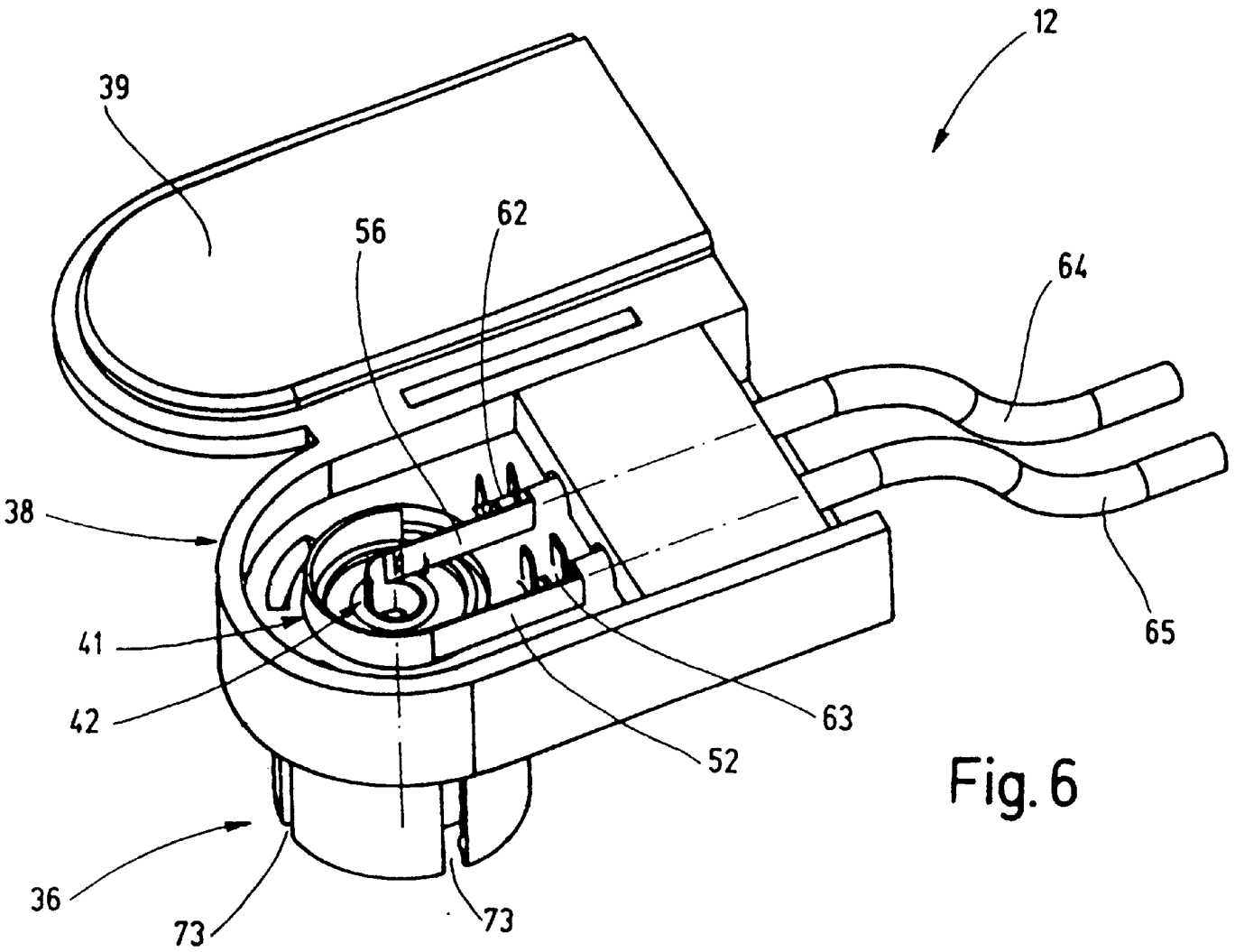
FIG. 6 is a top isometric view of the connector of FIG. 5, in an assembled state.
Figure 7:
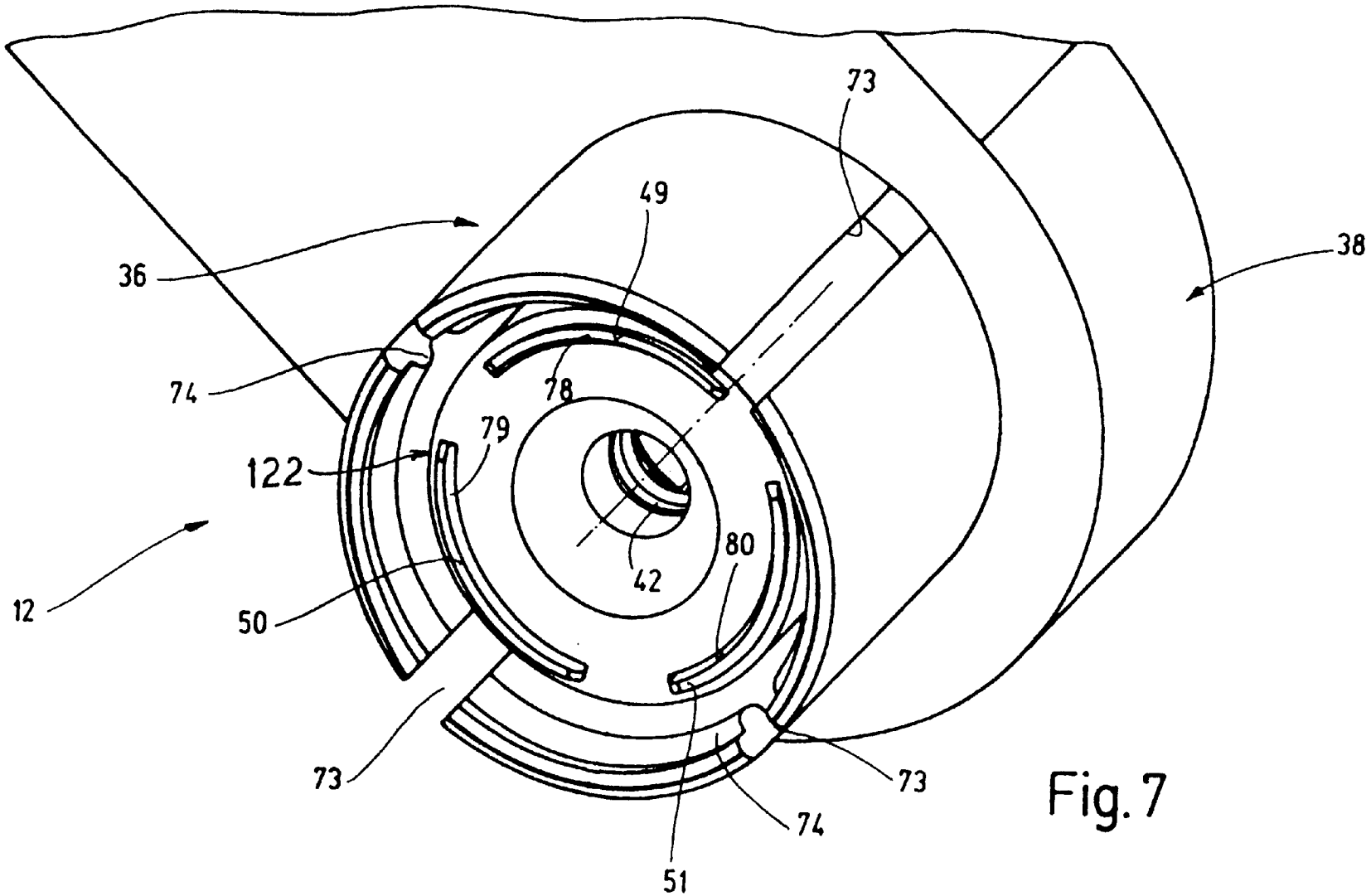
FIG. 7 is a partial isometric bottom view of the connector of FIG. 5 in an assembled state.
Figure 8B:
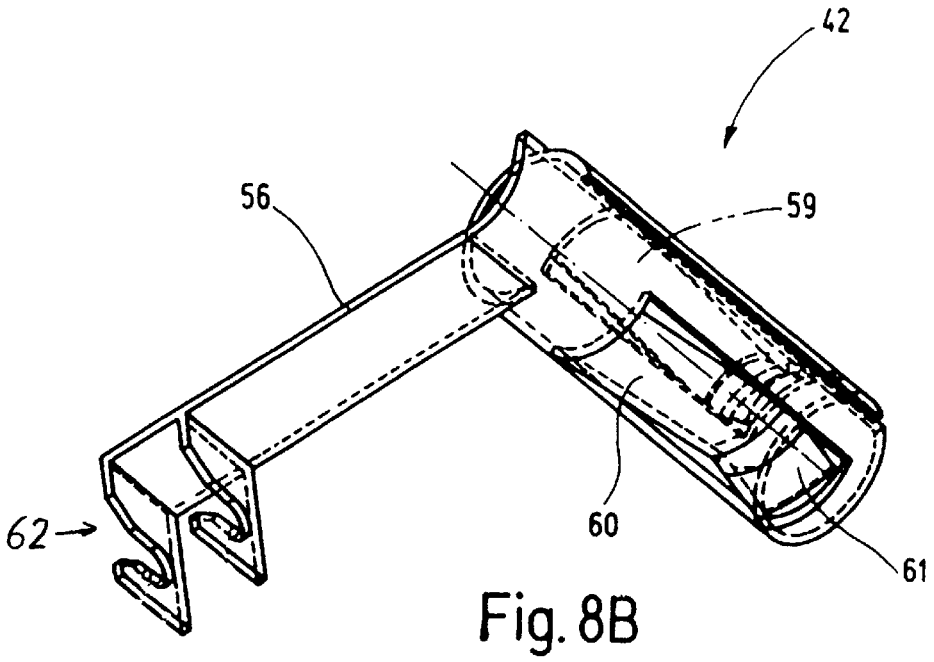
FIG. 8B is an isometric view of the inner contact of the second connector of FIG. 5.
Figure 8A:
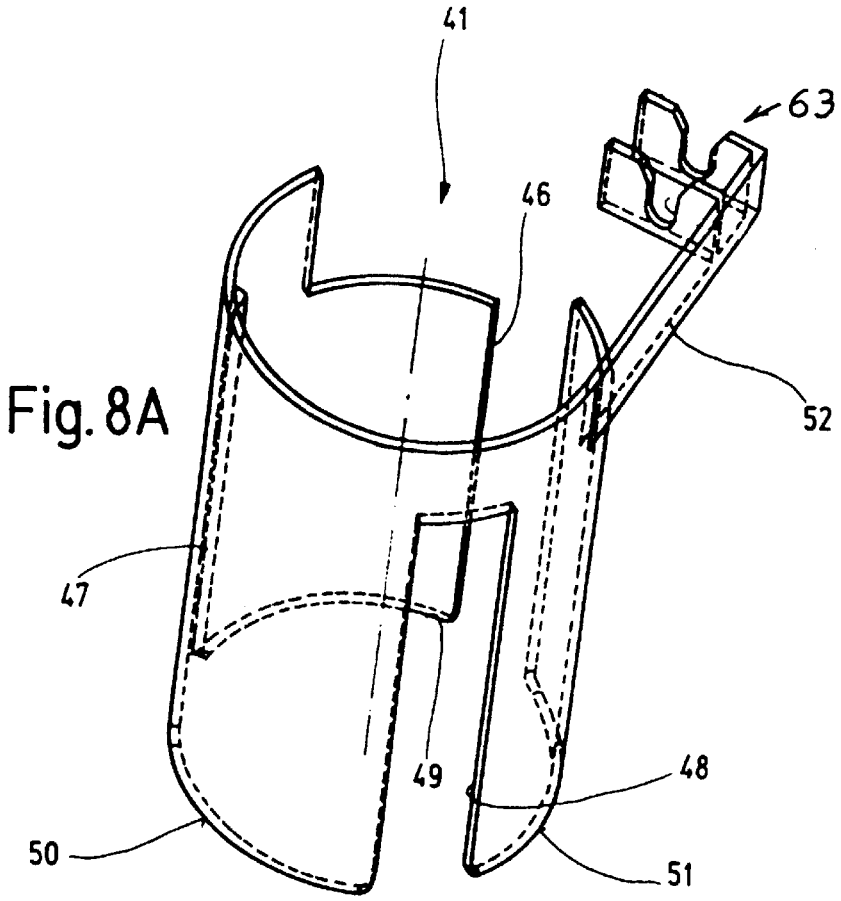
FIG. 8A is a top isometric view of the outer contact of the second connector of FIG. 5.

FIG. 6 shows that the inner and outer sleeve contacts 42, 41 of the second connector 12 have struts 56, 52 with insulation-displacing ends 62, 63. Ends of the wires 64, 65 are laid in the contact ends 62, 63 and a cap 39 of the second connector is closed to cause the connector ends to engage conductors within the wires. It also may be seen that the housing 36 has slits 73 that allow resilient radial deflection of the lower ends of the housing 36 during latching. FIG. 8A shows details of the outer contact sleeve 41 which has slits 46, 47, 48 that form free lower ends 49, 50, 51. FIG. 8B shows the construction of the inner contact sleeve 42 which has contact tines 59, 60 with lead-in ends 61. FIG. 7 shows that the dielectric deflection part 122 has three axial slits 78, 79, 80 that receive the lower ends 49, 50, 51 of the outer contact sleeve. The lower ends 49, 50, 51 project forward of the deflection part by less than the radius of the sleeve.

It is noted that the second connector 12 of FIG. 9 includes a ferrite core 43 located between the inner and outer contact sleeves 42, 41 for electrical enhancement of the circuitry. It should be noted that it is possible to mate the two connectors even though one of them is turned to any rotational orientation about its corresponding axis 104, 106. This is useful where the cable-connecting housing part 38 of the second connector must be rotated to a predetermined orientation.

The identification of contacts as being the "inner" or "outer" contact, refers to their relative positions such relative to an axis 104, 106. The described connectors are not designed for passing high frequency signals, but could be used to do so.

While terms such as "up", "top", "down", "bottom", etc. have been used to aid in describing the invention as illustrated, it is possible to use the connector assembly in any orientation with respect to the Earth.

Thus, the invention provides a connector assembly where each connector has first and second contacts for engagement with a corresponding contact when the connectors mate, which clearly indicates when less than full connector mating has occurred. One of the contacts includes a largely helical spring which is compressed as the contacts mate, and which pushes the contacts apart if the contacts have not been sufficiently mated by latching of a detent on one contact with a shoulder on the other. The spring forms the outer contact of one of the connectors. One end of the spring is bent to form a shorting prong that engages an exposed end of the inner contact, with the shorting contact being deflected onto an insulative body surrounding the inner contact when the connectors mate. The construction could be used for optical fiber contacts.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector assembly comprising:

first and second mateable connectors that each have at least a pair of contacts with said contacts of said connectors positioned to engage each other when the connectors mate;

one of said connectors has a detent and the other has a shoulder that engages said detent to latch said connectors together so as to resist their separation when said connectors are fully mated;

said first connector has a largely helical spring with an end that faces said second connector, and said second connector has means for compressing said spring as said connectors mate, with said spring pushing said connectors apart if they are mated insufficiently for said detent to engage said shoulder, each of said connectors includes first and second contacts, with the second contact of said first connector forming said helical spring.

2. The connector described in claim 1 wherein:

one of said contacts of said first connector comprises a center contact with an exposed mating end, and said first connector includes a first dielectric housing that includes a dielectric body surrounding said center contact at a location spaced from said mating end, and said helical spring extends around said center contact;

said spring has a mating end which is bent to form a shorting prong that extends to and engages said exposed mating end of said center contact.

3. The connector described in claim 2 wherein:

said first dielectric housing has a rear wall that has a hole;

said spring has a rear end is opposite said mating end, with said spring rear end projecting through said hole in said rear wall and forming an exposed rear electrical terminal.

4. An electrical connector assembly, comprising:

a first connector having a dielectric first housing and a first axis, said first connector having inner and outer first contacts that are mounted on said first housing to be substantially concentric with said first axis;

a second connector having a dielectric second housing and a second axis, said second connector having inner and outer second contacts that are mounted on said second housing to be substantially concentric with said second axis, said second contacts each having mateable front ends;

said outer second contact being in the form of an outer contact sleeve with a front part, and said outer first contact comprising a helical spring of electrically conductive material with a spring front end being positioned to be pressed rearwardly by said sleeve front part to compress said spring.

5. The assembly described in claim 4 wherein:

said first housing comprises a dielectric tube and said spring is positioned to lie closely within said tube with said tube having an inside which radially positions said spring.

6. The assembly described in claim 4 wherein:

one of said housings has a detent and the other has a groove positioned to receive said detent and resist unmating when said connectors become fully mated;

said spring has a sufficient resilience that it pushes said connectors apart at any degree of partial mating, but cannot push said connectors apart when said detent lies in said groove.

7. The assembly described in claim 4 including:

a dielectric inner body that surrounds a portion of said first inner contact, with said first inner contact having an exposed front end projecting forward of said inner body and with said inner body having a front end that is tapered to extend at a rearward and radially outward incline;

said spring has a front end which is bent to form a short circuit prong that extends largely radially inward, with said prong having a radially inner end that is resiliently biased against said contact front end;

said second connector includes a dielectric deflector part that is positioned to deflect said prong so it slides rearwardly and radially outwardly along said tapered body front end when said connectors mate.

8. The assembly described in claim 7 wherein:

said helical spring has a front turn from which said prong extends;

said second outer contact sleeve has a front end of a diameter that is about the same as the diameter of said spring front turn, so said sleeve front end engages and compresses said spring.

9. The assembly described in claim 4 wherein:

said second outer contact sleeve has a front end and has a plurality of primarily axial slits extending into said sleeve front end.

10. The assembly described in claim 4 including:

a hollow ferrite core lying between said inner second contact and said outer contact sleeve.

11. A first connector which includes a housing and a pair of contacts mounted on the housing with each contact having a mateable front end for mating with a second connector wherein:

one of said contacts of said first connector is in the form of a substantially helical spring with a front end having a spring turn that is exposed to be pushed rearwardly by a contact of said second connector so said spring is compressed when said connectors mate.

12. The first connector described in claim 11 including said second connector, and wherein:

said second connector has an outer sleeve contact with a front end of about the same diameter as said spring front end turn to engage and compress said spring.

13. The first connector described in claim 12 wherein:

said first housing has a rear wall with a pair of holes;

a second contact of said first connector comprises a pin that has a rear end that projects through and rearwardly beyond said rear wall, and said pin has an exposed front end;

said helical spring has a rear end that projects through and rearwardly beyond said rear wall, and said spring has a front end which is bent to form a prong that engages said pin exposed front end but which can be deflected out of contact with said pin, with said second connector having means for deflecting said prong out of contact with said pin.

14. The first connector described in claim 12 wherein:

said first housing includes a tubular part that closely surrounds said spring, and said second housing has a guide that fits closely within said tube, with said outer sleeve contact front end projecting forward of said guide by a distance less than the radius of said outer sleeve.

* * * * *